US010199718B2

(12) United States Patent
Khalifa et al.

(10) Patent No.: US 10,199,718 B2
(45) Date of Patent: Feb. 5, 2019

(54) ELECTRONIC DEVICE ANTENNA FEED AND RETURN PATH STRUCTURES

(71) Applicant: Apple Inc., Cupertino, CA (US)

(72) Inventors: Sammy M. Khalifa, Mountain View, CA (US); Daniel Lau, Santa Clara, CA (US); Scott A. Myers, San Francisco, CA (US); Richard A. Besen, San Francisco, CA (US); Gregory N. Stephens, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 700 days.

(21) Appl. No.: 14/822,091

(22) Filed: Aug. 10, 2015

(65) Prior Publication Data

US 2016/0072178 A1 Mar. 10, 2016

Related U.S. Application Data

(60) Provisional application No. 62/047,547, filed on Sep. 8, 2014.

(51) Int. Cl.

| | |
|---|---|
| ***H01Q 1/24*** | (2006.01) |
| ***H01Q 1/36*** | (2006.01) |
| ***H01Q 13/10*** | (2006.01) |

(52) U.S. Cl.

CPC ..... *H01Q 1/243* (2013.01); *H01Q 1/36* (2013.01); *H01Q 13/10* (2013.01)

(58) Field of Classification Search

CPC ..... H01Q 13/10; H01Q 1/243; H01Q 1/36; H05K 2201/10371; H05K 5/0247; H05K 1/0215

See application file for complete search history.

(56) References Cited

U.S. PATENT DOCUMENTS

| | | | | |
|---|---|---|---|---|
| 6,329,960 | B1 | 12/2001 | Andrew et al. | |
| 8,506,327 | B2 | 8/2013 | Jol | |
| 8,928,538 | B2 | 1/2015 | Montgomery et al. | |
| 2007/0115188 | A1* | 5/2007 | Mizoguchi | H01Q 1/22 343/702 |
| 2008/0074329 | A1* | 3/2008 | Caballero | H01Q 1/088 343/702 |
| 2011/0316751 | A1* | 12/2011 | Jarvis | H01Q 1/243 343/702 |

(Continued)

*Primary Examiner* — James Wu

(74) *Attorney, Agent, or Firm* — Treyz Law Group, P.C.; G. Victor Treyz; Michael H. Lyons

(57) ABSTRACT

An antenna may be formed from a peripheral conductive housing structure in an electronic device that is separated from an antenna ground by a gap. An antenna feed may be formed from a metal trace on a flexible printed circuit that spans the gap. The metal trace may have a line segment that joins a wider pad portion of the trace at a junction. A stiffener on the flexible printed circuit may have a protrusion that overlaps the junction. A metal bracket attached to the peripheral housing structure may be soldered to the pad. A metal member with meandering paths may form a return path in the antenna. The meandering path may have parallel segments that extend along an inner surface of the peripheral conductive housing structure to prevent the metal member from rotating when a screw is used to screw the metal member to the peripheral conductive housing structure.

18 Claims, 7 Drawing Sheets

(56) References Cited

U.S. PATENT DOCUMENTS

| | | | | |
|---|---|---|---|---|
| 2012/0176279 | A1* | 7/2012 | Merz | H01Q 1/243 343/702 |
| 2012/0176754 | A1* | 7/2012 | Merz | H01Q 1/243 361/751 |
| 2012/0206301 | A1 | 8/2012 | Flores-Cuadras et al. | |
| 2013/0050046 | A1* | 2/2013 | Jarvis | H01Q 1/243 343/852 |
| 2013/0257659 | A1* | 10/2013 | Darnell | H01Q 1/243 343/702 |
| 2014/0306857 | A1* | 10/2014 | Bevelacqua | H01Q 1/243 343/750 |
| 2014/0340265 | A1* | 11/2014 | Vazquez | H01Q 9/42 343/702 |
| 2015/0243937 | A1 | 8/2015 | Dinh et al. | |
| 2015/0311579 | A1* | 10/2015 | Irci | H01Q 1/243 343/702 |

* cited by examiner

ELECTRONIC DEVICE ANTENNA FEED AND RETURN PATH STRUCTURES

This application claims the benefit of provisional patent application No. 62/047,547 filed on Sep. 8, 2014, which is hereby incorporated by reference herein in its entirety.

BACKGROUND

This relates generally to electronic devices and, more particularly, to electronic devices with electrical paths for carrying signals such as antenna signals.

Electronic devices often include wireless circuitry with antennas. For example, cellular telephones, computers, and other devices often contain antennas for supporting wireless communications.

It can be challenging to form electronic device signal path structures with desired attributes. In some wireless devices, flexible printed circuits are used to carry signals such as antenna signals. Metal members such as brackets can also carry signals. Flexible printed circuits have metal traces on a flexible polymer substrate. If a flexible printed circuit is not adequately supported, stresses may develop that crack the metal traces. This can make flexible printed circuits less reliable than desired for carrying sensitive signals such as antenna signals. Metal members can be difficult to align and install properly. Without proper installation and alignment, an antenna that includes a signal-carrying metal member may not operate satisfactorily.

It would therefore be desirable to be able to provide improved signal carrying structures for electronic devices such as electronic devices with antennas.

SUMMARY

An electronic device may have circuitry such as wireless circuitry. The wireless circuitry may include one or more antennas. An electronic device housing may be formed from conductive structures such as metal. Signal path structures may be used to convey signals between conductive device structures, wireless circuitry, antennas, and other circuitry in an electronic device. The signal path structures may be formed using flexible printed circuits, metal members, and other signal path structures.

An antenna may be formed from a peripheral conductive housing structure that is separated from an antenna ground by a gap. An antenna feed may be formed from a metal trace on a flexible printed circuit that spans the gap. The metal trace may have a line segment that joins a wider pad portion of the trace at a junction. A stiffener on the flexible printed circuit may have a protrusion that overlaps the junction to prevent bending stress from cracking the metal line segment in the vicinity of the junction. A metal bracket that is attached to the peripheral housing structure may be soldered to the pad.

A metal member with meandering paths may span the gap and may form a return path in the antenna. The length of the meandering path may be adjusted when it is desired to adjust antenna performance during manufacturing. The meandering path may have parallel segments that extend along an inner surface of the peripheral conductive housing structure to prevent the metal member from rotating when a screw is used to screw the metal member to the peripheral conductive housing structure.

DETAILED DESCRIPTION

Figure 1:
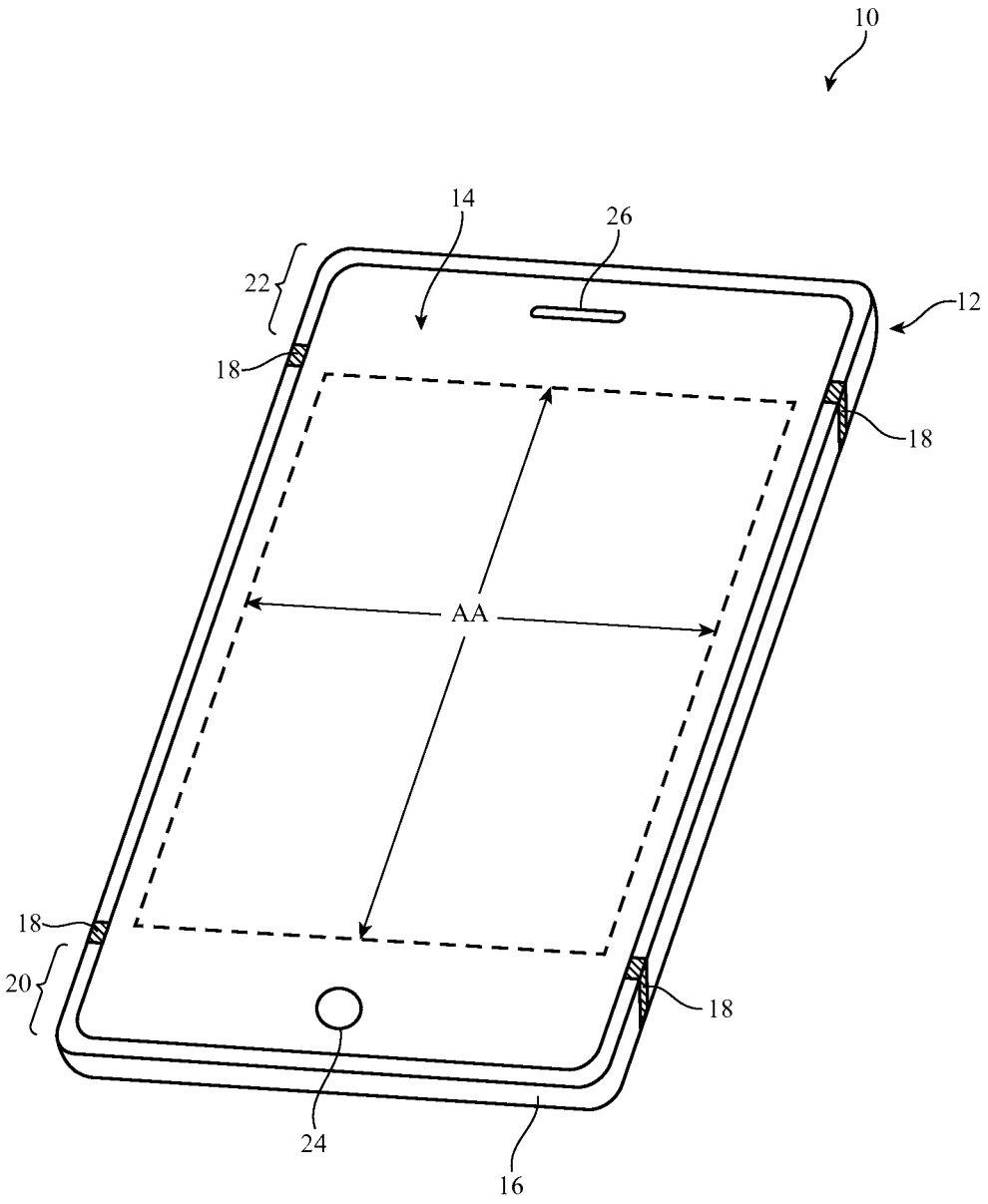
FIG. 1 is a perspective view of an illustrative electronic device in accordance with an embodiment.

Electronic devices such as electronic device 10 of FIG. 1 may be provided with circuitry such as wireless communications circuitry. Signal paths for conveying signals within the circuitry may be formed using metal members, using signal lines in printed circuits, and using other conductive structures. Signal paths such as these may, for example, be used to route signals within wireless circuits such as antennas and may be used to route signals between other electrical structures (e.g., integrated circuits and other electrical components). Configurations in which signal path structures are used in handling antenna signals associated with one or more antennas in electronic device 10 are sometimes described herein as an example. This is merely illustrative. In general, any suitable signals may be conveyed using metal members, signal lines in printed circuits, and other conductive structures in electronic devices such as electronic device 10.

Device 10 may include one or more antennas such as loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures and internal structures (e.g., brackets, metal members that are formed using techniques such as stamping, machining, laser cutting, etc.), and other conductive electronic device structures. The housing structures may include peripheral structures such as peripheral conductive structures that run around the periphery of an electronic device. The peripheral conductive structure may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures. Gaps may be formed in the peripheral conductive structures that divide the peripheral conductive structures into peripheral segments. One or more of the segments may be used in forming one or more antennas for electronic device 10. Antennas may also be formed using an antenna ground plane formed from conductive housing structures such as metal housing midplate structures and other internal device structures. Rear housing wall structures may be used in forming antenna structures such as an antenna ground.

Electronic device 10 may be a portable electronic device or other suitable electronic device. For example, electronic device 10 may be a laptop computer, a tablet computer, a somewhat smaller device such as a wristwatch device, pendant device, headphone device, earpiece device, or other wearable or miniature device, a handheld device such as a cellular telephone, a media player, an electronic stylus, or other small portable device. Device 10 may also be a television, a set-top box, a desktop computer, a computer monitor into which a computer has been integrated, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

The rear face of housing 12 may have a planar housing wall. The rear housing wall may be formed from metal with one or more regions that are filled with plastic or other dielectric. Portions of the rear housing wall that are separated by dielectric in this way may be coupled together using conductive structures (e.g., internal conductive structures) and/or may be electrically isolated from each other.

Device 10 may, if desired, have a display such as display 14. Display 14 may be mounted on the opposing front face of device 10 from the rear housing wall. Display 14 may be a touch screen that incorporates capacitive touch electrodes or may be insensitive to touch.

Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A display cover layer such as a layer of clear glass or plastic, a layer of sapphire, a transparent dielectric such as clear ceramic, fused silica, transparent crystalline material, or other materials or combinations of these materials may cover the surface of display 14. Buttons such as button 24 may pass through openings in the cover layer. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape with four edges, structures 16 may be implemented using peripheral housing structures that have a rectangular ring shape with four corresponding edges (as an example). Peripheral structures 16 or part of peripheral structures 16 may serve as a bezel for display 14 (e.g., a cosmetic trim that surrounds all four sides of display 14 and/or that helps hold display 14 to device 10). Peripheral structures 16 may also, if desired, form sidewall structures for device 10 (e.g., by forming a metal band with vertical sidewalls, by curved sidewalls that extend upwards as integral portions of a rear housing wall, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. The bottom portion of peripheral housing structures 16 may also have an enlarged lip (e.g., in the plane of the rear surface of device 10). Peripheral housing structures 16 may have substantially straight vertical sidewalls, may have sidewalls that are curved, or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the sides of housing 12 may be formed as vertically extending integral metal portions of the planar metal structure. Housing structures such as these may, if desired, be machined from a block of metal and/or may include multiple metal pieces that are assembled together to form housing 12. The planar rear wall of housing 12 may have one or more, two or more, or three or more portions.

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a substantially rectangular sheet formed from one or more parts that is welded or otherwise connected between opposing sides of member 16), printed circuit boards, and other internal conductive structures. These conductive structures, which may be used in forming a ground plane in device 10, may be located in the center of housing 12 under active area AA of display 14 (e.g., the portion of display 14 that contains a display module for displaying images).

In regions such as regions 22 and 20, openings may be formed within the conductive structures of device 10 (e.g., between peripheral conductive housing structures 16 and opposing conductive ground structures such as conductive housing midplate or rear housing wall structures, a printed circuit board, and conductive electrical components in display 14 and device 10). These openings, which may sometimes be referred to as gaps, may be filled with air and/or solid dielectrics such as plastic, glass, ceramic, polymers with fiber filler material (e.g., fiber composites), sapphire, etc.

Conductive housing structures and other conductive structures in device 10 such as a midplate, traces on a printed circuit board, display 14, and conductive electronic components may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, the ground plane that is under active area AA of display 14 and/or other metal structures in device 10 may have portions that extend into parts of the ends of device 10 (e.g., the ground may extend towards the dielectric-filled openings in regions 20 and 22).

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of these locations. The arrangement of FIG. 1 is merely illustrative.

Portions of peripheral housing structures 16 may be provided with gap structures. For example, peripheral housing structures 16 may be provided with one or more peripheral gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two gaps), three peripheral conductive segments (e.g., in an arrangement with three gaps), four peripheral conductive segments (e.g., in an arrangement with four gaps, etc.). The segments of peripheral conductive housing structures 16 that are formed in this way may form parts of antennas in device 10. If desired, gaps may extend across the width of the rear wall of housing 12 and may penetrate through the rear wall of housing 12 to divide the rear wall into different portions. Polymer or other dielectric may fill these housing gaps (grooves).

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
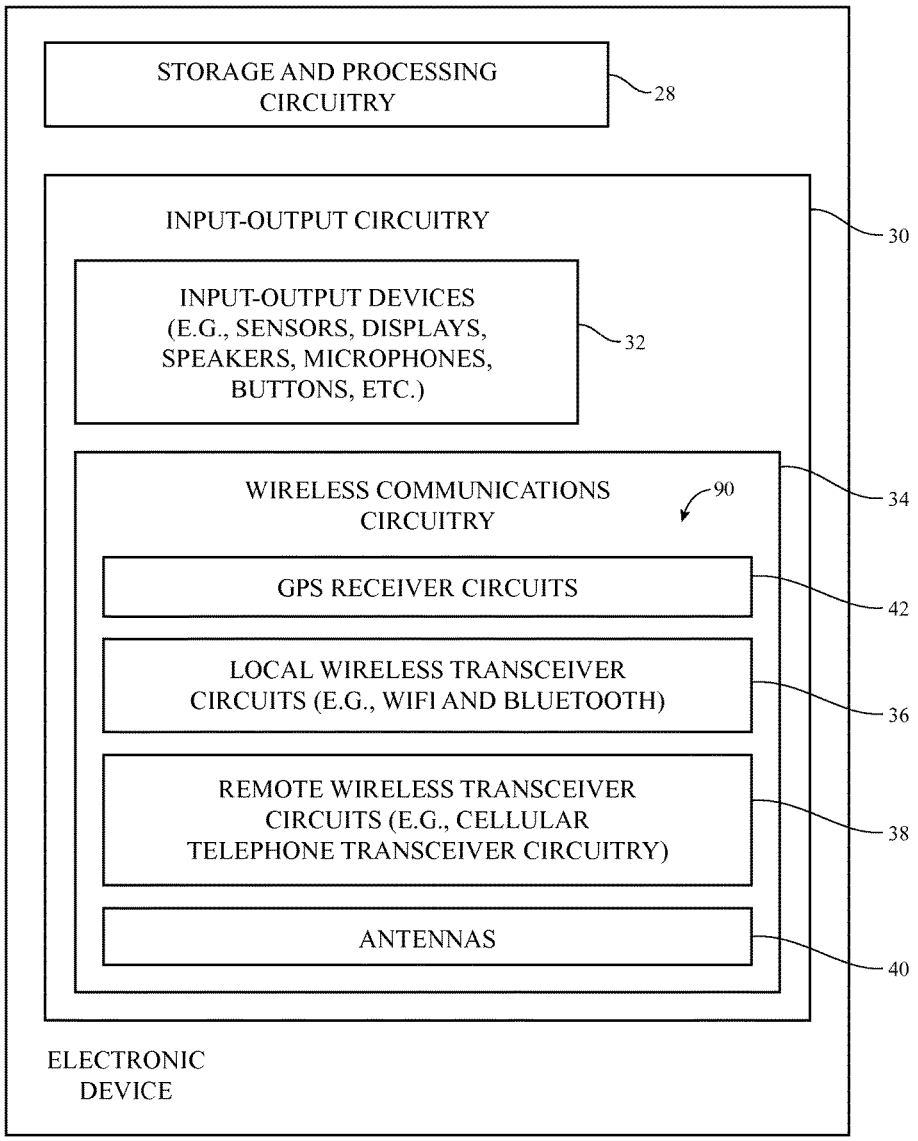
FIG. 2 is a schematic diagram of illustrative circuitry in an electronic device in accordance with an embodiment.

A schematic diagram showing illustrative components that may be used in device 10 of FIG. 1 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, fingerprint sensors (e.g., a fingerprint sensor integrated with a button such as button 24 of FIG. 1), etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in frequency ranges such as a low communications band from 700 to 960 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include global positioning system (GPS) receiver equipment such as GPS receiver circuitry 42 for receiving GPS signals at 1575 MHz or for handling other satellite positioning data.

In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include one or more antennas such as antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
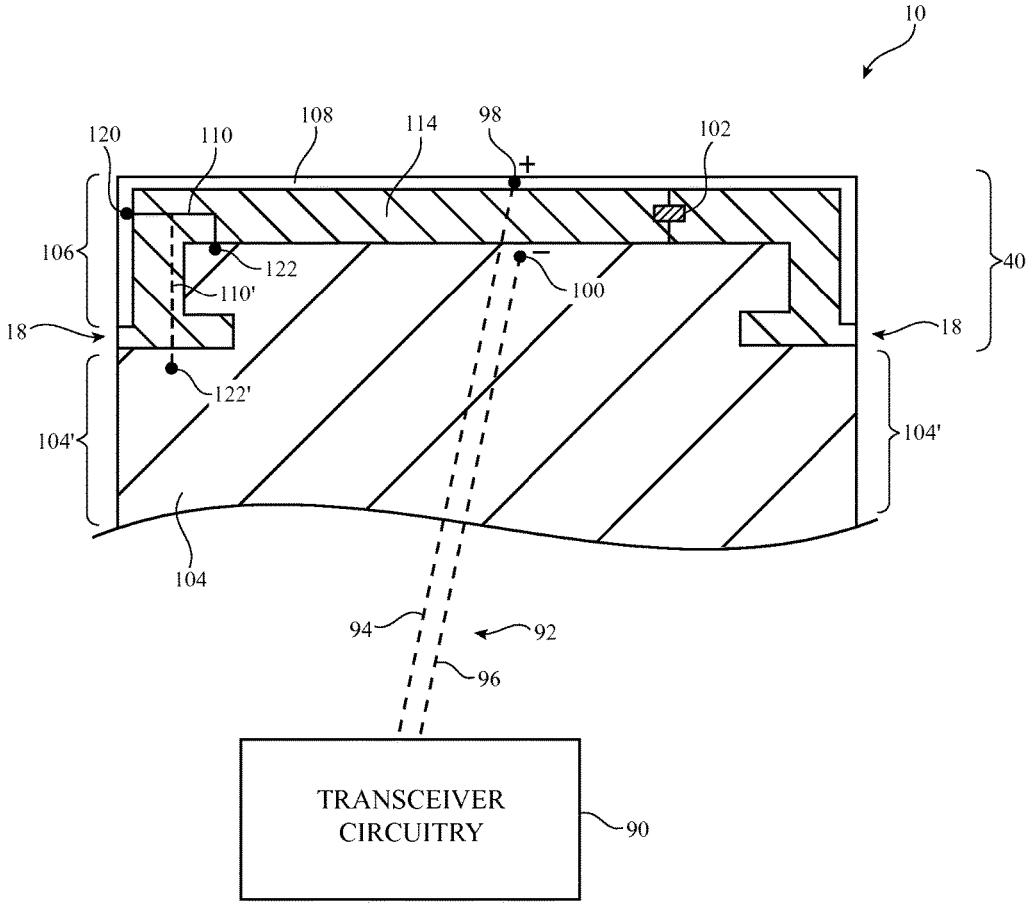
FIG. 3 is a top interior view of a portion of an electronic device having an antenna in accordance with an embodiment.

An interior top view of an illustrative antenna of the type that may be formed in device 10 is shown in FIG. 3. Antenna 40 of FIG. 3 may be formed at end 20, end 22, or other portion of device 10. The configuration for antenna 40 of FIG. 3 is based on an inverted-F antenna design with a slot resonating element (i.e., antenna 40 of FIG. 3 is a hybrid inverted-F slot antenna). This is merely illustrative. Antenna 40 may be any suitable type of antenna.

As shown in FIG. 3, antenna 40 may be coupled to transceiver circuitry 90, so that transceiver circuitry 90 may transmit antenna signals through antenna 40 and may receive antenna signals through antenna 40.

Transceiver circuitry 90 may be coupled to antenna 40 using paths such as transmission line path 92. Transmission line 92 may include positive signal line (path) 94 and ground signal line (path) 96. Transmission line 92 may be coupled to an antenna feed for antenna 40 that is formed from positive antenna feed terminal 98 and ground antenna feed terminal 100. Positive signal line 94 may be coupled to positive antenna feed terminal 98 and ground signal line 96 may be coupled to ground antenna feed terminal 100. If desired, impedance matching circuitry, switching circuitry, filter circuitry, and other circuits may be interposed in the path between transceiver circuitry 90 and antenna 40.

Antenna 40 of FIG. 3 includes inverted-F antenna resonating element 106 and antenna ground 104. Ground 104 may be formed from metal portions of housing 12 (e.g., portions of the rear wall of housing 12, a housing midplate, etc.), conductive structures such as display components and other electrical components, ground traces in printed circuits, etc. For example, ground 104 may include portions such as portions 104' that are formed from metal housing walls, a metal band or bezel, or other peripheral conductive housing structures.

Antenna resonating element 106 may be formed from conductive structure 108. Structure 108 may be formed from peripheral conductive housing structure in device 10 (e.g., a segment of structures 16 of FIG. 1) or other conductive structure. Structure 108 may form a main resonating element arm for inverted-F antenna resonating element 106 and may have left and right ends that are separate from ground structure 104' by peripheral gaps 18.

Conductive structure 108 may have long and short branches (to the opposing sides of the antenna feed in the orientation of FIG. 3) that support respective lower and higher frequency antenna resonances (e.g., low band and mid-band resonances). Inverted-F antennas that have opposing branches such as these may sometimes be referred to as T antennas or multi-branch inverted-F antennas.

Dielectric 114 may form a gap that separates structure 108 from ground 104. The shape of the dielectric gap associated with dielectric 114 may form a slot antenna resonating element (i.e., the conductive structures surrounding dielectric 114 may form a slot antenna). The slot antenna resonating element may support an antenna resonance at higher frequencies (e.g., a high band resonance). Higher frequency antenna performance may also be supported by harmonics of the lower-frequency resonances associated with the longer and shorter branches of structure 108.

One or more electrical components such as component 102 may span dielectric gap 114. Components 102 may include resistors, capacitors, inductors, switches and other structures to provide tuning capabilities, etc. Components 102 may be used to tune the performance of antenna 40 dynamically during antenna operation and/or may include fixed components.

Return path 110 may be coupled between the main inverted-F resonating element arm formed from structure 108 and antenna ground 104 in parallel with the antenna feed formed by feed terminals 98 and 100. Return path 110 may be formed from a metal member having opposing first and second ends. In the example of FIG. 3, return path 110 is formed from a metal structure that has a first end with a terminal 120 coupled to structure 108 of inverted-F antenna resonating element 106 (e.g., on a housing sidewall or other peripheral conductive structure) and has a second end with a terminal 122 coupled to antenna ground 104. Return path 110 may have other shapes and sizes, as illustrated, for example, by dashed line 110' and illustrative terminal 122'.

Figure 4:
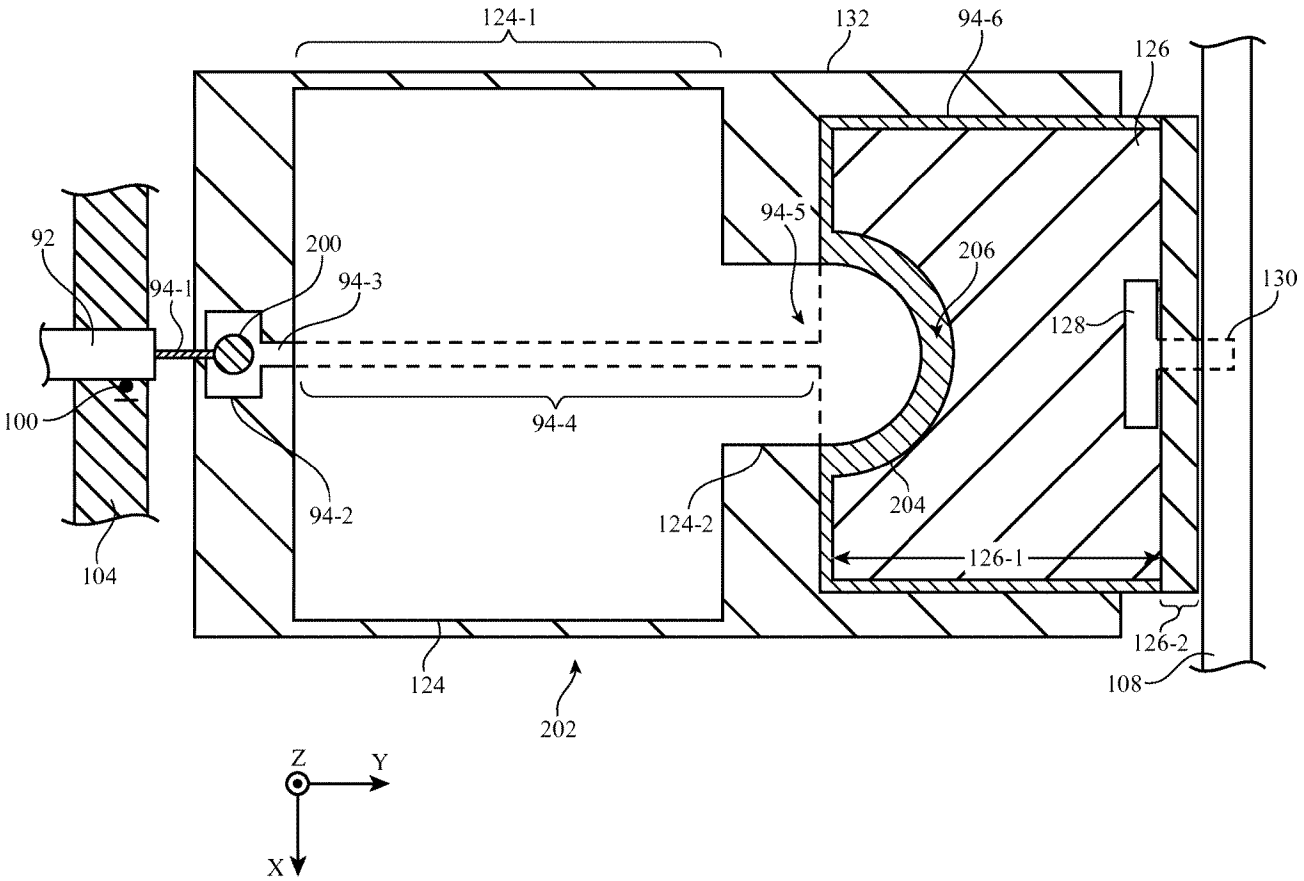
FIG. 4 is a top view of an illustrative antenna feed structure in accordance with an embodiment.

FIG. 4 is a top view of illustrative structures that may be used in forming an antenna feed connection for antenna 40 of FIG. 3. Coaxial cable 92 may form a transmission line path that is coupled between transceiver circuitry 90 and the antenna feed for antenna 40. An outer ground path conductor in the coaxial cable may be coupled to antenna ground 104 at ground terminal 100 (see, e.g., terminal 100 of FIG. 3). Solder or other conductive material may be used in coupling the ground line in cable 92 to ground 104. The coaxial cable may also have a positive inner conductor such as conductor 94-1. Conductor 94-1 may be soldered to solder pad 94-2 on flexible printed circuit 202 using solder 200.

Solder pad 94-2 may form part of a metal trace on flexible printed circuit 202 that couples positive signal line 94-1 to peripheral conductive housing structure 108. The metal trace may be formed from copper or other metal. The metal trace may include pad 94-2, line 94-3, line 94-4, and solder pad 94-6. Metal bracket 126 may have a horizontal portion such as portion 126-1 that is soldered to solder pad 94-6 and an integral vertical portion such as portion 126-2 that lies parallel to the inner surface of structure 108 (e.g., a peripheral conductive housing structure such as a sidewall in housing 12). Metal screw 128 may be used to mechanically attach and electrically couple vertical portion 126-2 of metal bracket 126 to structure 108.

Flexible printed circuit 202 has a flexible substrate such as substrate 132. Substrate 132 may be, for example, a flexible polymer layer such as a sheet of polyimide. To ensure that flexible printed circuit 202 has sufficient stiffness to resist damage, the upper surface of substrate 132 may be covered with a stiffener such as stiffener 124. Stiffener 124 may be formed from a rigid layer of polymer (e.g., a relatively thick polyimide layer) or other suitable structure for locally enhancing the stiffness of flexible printed circuit 202.

Stiffener 124 may have a portion such as rectangular portion 124-1 that covers metal trace segment 94-4 and a protruding portion such as protrusion 124-2. Bracket 126 may include recess 204. Recess 204 may have a shape that accommodates protrusion 124-2. For example, protrusion 124-2 may have an elongated shape with a rounded tip and recess 204 may have a correspondingly rounded opening that receives the rounded tip. Shapes without rounded edges may also be used, if desired.

Gap 206 separates protrusion 124-2 from the edge of recess 204 in bracket 126. In this region, flexible printed circuit substrate 132 is not locally stiffened by overlapping stiffener structures. Accordingly, the metal of pad 94-6 in gap 206 has the potential to develop cracks during use of device 10 (e.g., when device 10 experiences stresses during a drop event, etc.). Nevertheless, the amount of material in pad 94-6 that spans gap 206 is considerably larger than the amount of material associated with metal trace segment 94-4 on substrate 132 at junction 94-5 between metal trace segment 94-4 and pad 94-6. Metal trace segment 94-4 is relatively narrow. Pad 94-6 is wider than trace 94-4. The metal trace portion at junction 94-5 may be sensitive to bending stress and potential stress-induced cracks, due to the relatively narrow width of metal trace segment 94-4. With the arrangement of FIG. 4, the metal trace at junction 94-5 is covered by stiffener protrusion 124-2 and is therefore protected from bending stress. The arrangement of FIG. 4 therefore helps shield the sensitive portion of the metal trace (i.e., the portion of the metal at junction 94-5 between line 94-4 and pad 94-6) from bending stress and potential crack formation and only exposes the robust portion of the metal trace (i.e., the portion of pad 94-6 in gap 206) to bending stress. There is more material in portion 94-6 overlapping gap 206 than other portions of the metal trace and gap 206 is spatially distributed, so the portion of the trace in gap 206 is less likely to receive concentrated bending stress and, in any event, can experience small amounts of cracking without adversely affecting the reliability of the signal path between pad 94-2 and structure 108.

Figure 5:
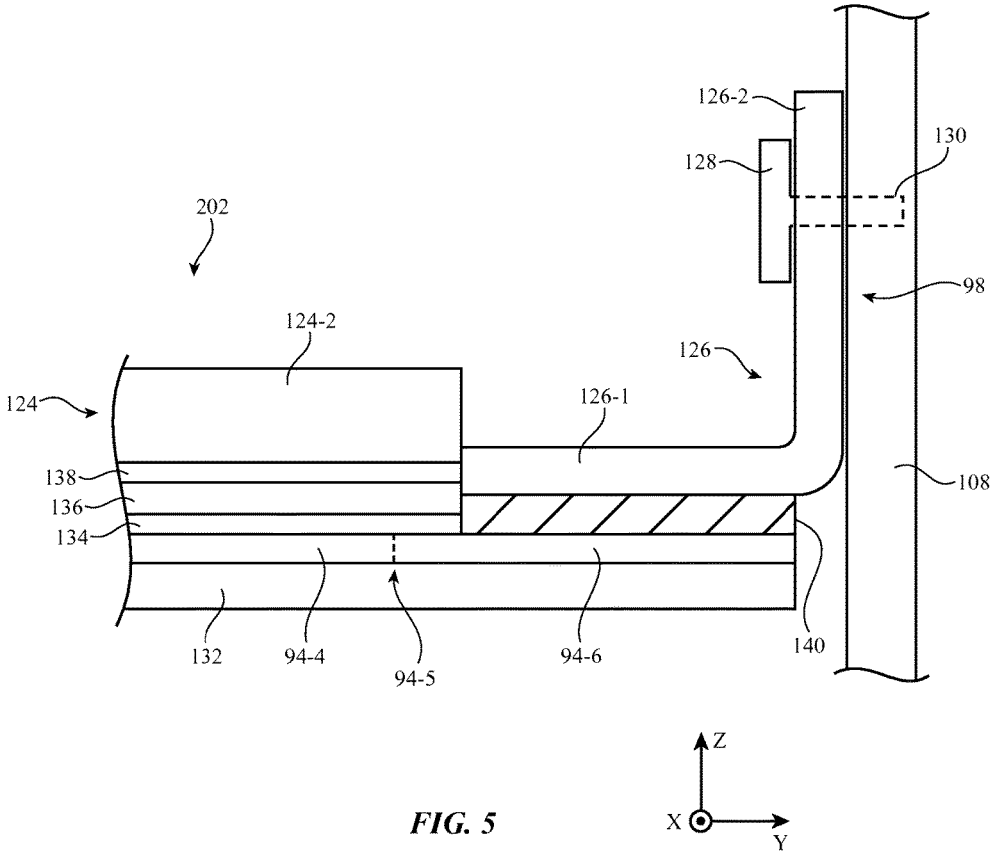
FIG. 5 is a side view of the antenna feed structure of FIG. 4 in accordance with an embodiment of the present invention.

FIG. 5 is a cross-sectional side view of flexible printed circuit 202 of FIG. 4. As shown in FIG. 5, flexible printed circuit 202 includes substrate 132. Stiffener 124 includes protrusion 124-2, which overlaps stress-sensitive junction 94-5 between relatively narrower trace portion 94-4 and wider pad portion 94-6 of the metal trace on substrate 132. Adhesive layer 134 attaches a polymer layer such as coverlay 136 to printed circuit 202 over the metal trace. Adhesive 138 attaches polyimide stiffener layer 124 to the top surface of flexible printed circuit 202 (e.g., to coverlay 136). Metal bracket 126 has horizontal portion 126-1 and vertical portion 126-2. Horizontal portion 126-1 is soldered to pad 94-6 using solder 140. Vertical portion 126-2 is attached to structure 108 using screw 128. Screw 128 may have a threaded shaft such as shaft 130 that is received within a mating threaded hole in structure 108. The electrical connection formed by bracket portion 126-2 and screw 128 form positive antenna feed terminal 98 on resonating element 106.

Figure 6:
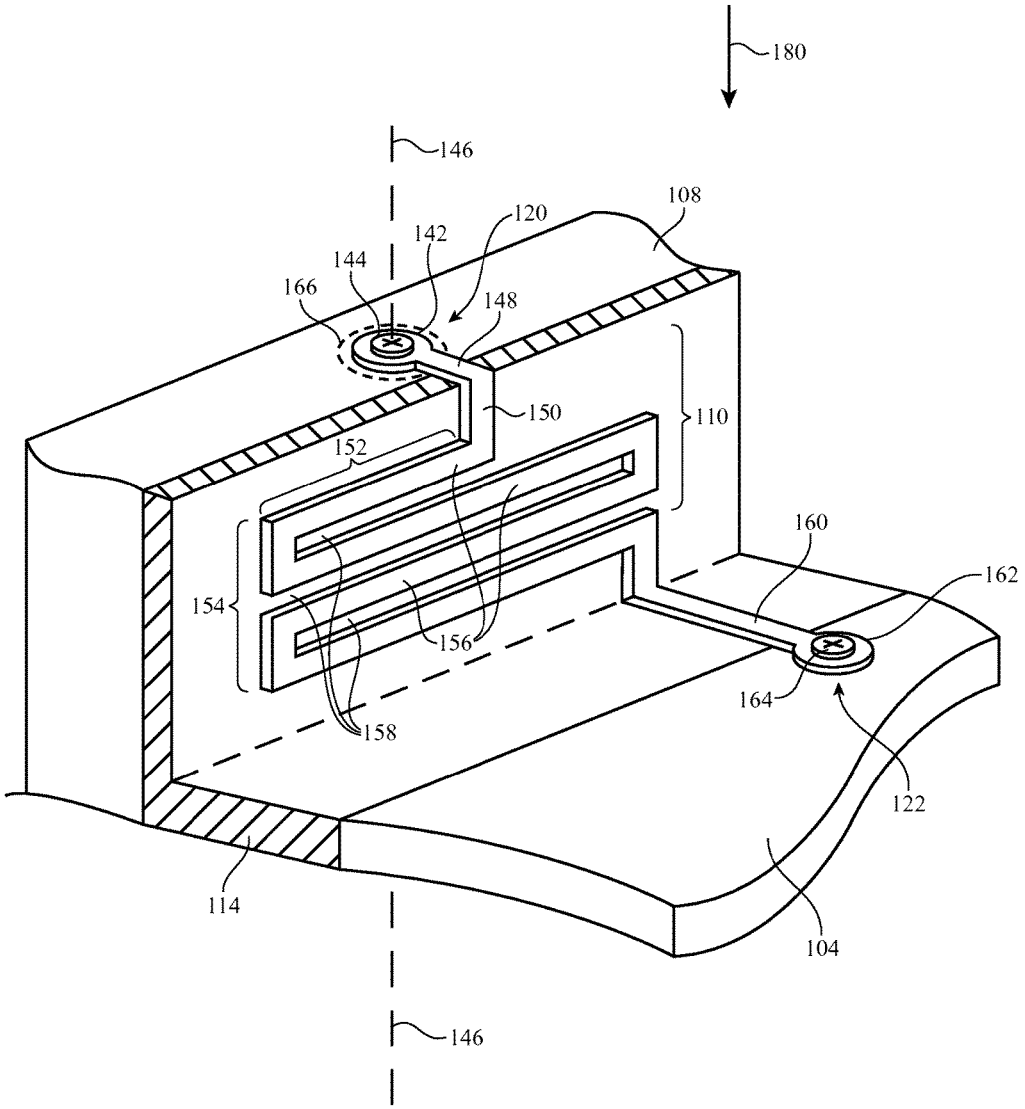
FIG. 6 is a perspective view of an interior portion of a housing wall and associated metal antenna return path structure in an antenna in accordance with an embodiment.

An illustrative signal path structure that may be used for forming return path 110 is shown in FIG. 6. As shown in FIG. 6, the return path may be formed from a metal member with a meandering signal path (metal member 110). Portion 142 of metal member 110 may screwed into structure 108 (e.g., an upper surface of structure 108) at terminal 120 by rotating screw 144 about rotational axis 146. The shaft of screw 144 may be threaded and may be received within mating threads in a hole in structure 108. If desired, structure 108 may include a recessed portion such as portion 166 so that screw 144 and portion 142 do not protrude excessively above the surface of structure 108.

Horizontal segment 148 of member 110 couples portion 142 of member 110 to vertical segment 150 of member 110. Meandering signal paths 154 are formed from a series of parallel segments 152 of member 110 that run horizontally along the inner surface of structure 108 (i.e., parallel to structure 108, which runs along the peripheral edges of device 10). Dielectric 114 may separate metal member 110 from structure 108 (e.g., to prevent undesired shorts). Gaps 158 may separate the horizontal segments of member 110 that form the meandering path portion 154 of member 110.

The length of the signal path in member 110 may be adjusted by adjusting the lengths of the segments of the meandering path 154, allowing the frequency response of antenna 40 to be adjusted during manufacturing. Horizontal segment 160 of member 110 may couple meandering path portion 154 to portion 162 of member 110. Portion 162 may be attached to antenna ground 104 using screw 164 at terminal 122.

Figure 7:
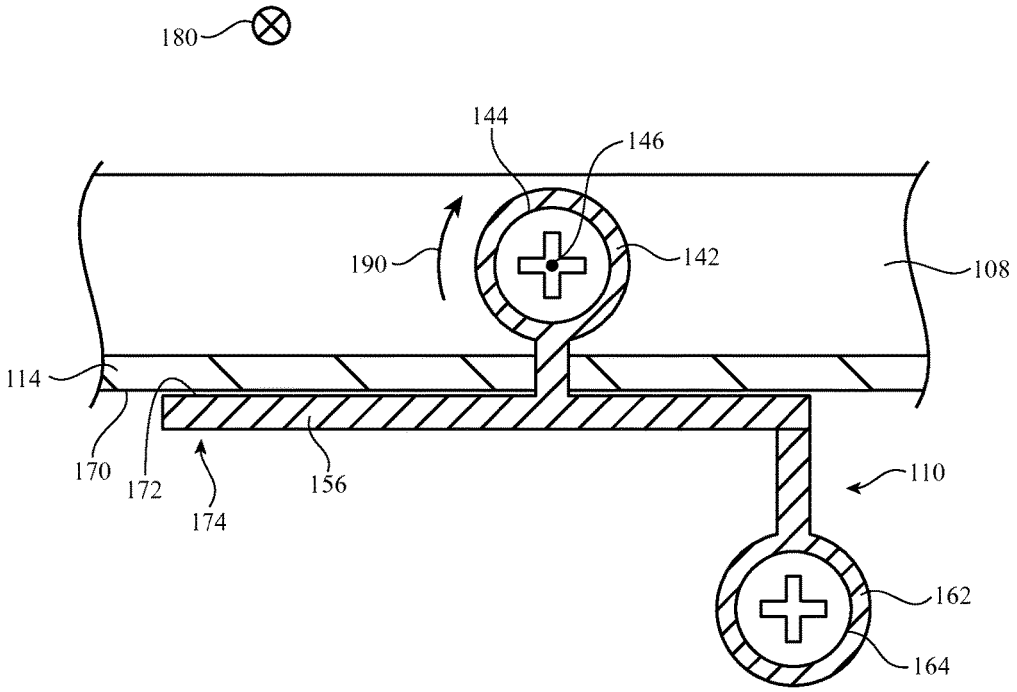
FIG. 7 is a top view of the metal antenna return path structure of FIG. 6 in accordance with an embodiment.

The presence of laterally extending protruding portions of member 110 such as meandering path segments 156 forms a lever arm that helps prevent undesired movement of member 110 when member 110 is being attached to structure 108 by screw 144. FIG. 7 is a top view of the structures of FIG. 6 when viewed in direction 180. As shown in FIG. 7, when screw 144 is being rotated clockwise about axis 146 in direction 190, there is a tendency of the head of screw 144 to engage portion 142 of member 110, thereby rotating member 110 about axis 146. This could misalign member 110 (e.g., so that subsequent installation of screw 164 at terminal 122 might be difficult or impossible). Due to the presence of segments 156, rotation of member 110 in direction 190 about axis 146 is prevented. This is because surface 172 of member 110 at tip 174 of segment 156 bears against exposed surface 170 of dielectric coating layer 114 on the inner surface of structure 108. If desired, other shapes may be used for member 110 that have meandering paths or other conductive portions that protrude laterally (parallel to the edges of device 10) along the inner surface of structure 108. The configuration of FIG. 7 is merely illustrative.

If desired, signal path structures such as the flexible printed circuit structure of FIGS. 3 and 4 and the metal member of FIGS. 6 and 7 may be used for carrying antenna signals in other portions of antenna 40 (e.g., portions other than the antenna feed and return path for antenna 40) and/or may carry other signals in device 10. The use of these structures to carry antenna feed signals and antenna return path signals in a hybrid inverted-F slot antenna has been described herein as an example.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a housing;

a flexible printed circuit having a metal trace that forms a signal line coupled to a solder pad at a junction, wherein the solder pad is wider than the signal line;

a stiffener layer that overlaps the junction and at least part of the solder pad; and a metal bracket soldered to the solder pad, wherein the stiffener layer has a lateral surface that extends along a surface of the flexible printed circuit, the stiffener layer comprises a portion with a first lateral width and a protrusion extending from an end of the portion, the protrusion has a second lateral width that is less than the first lateral width, and the protrusion overlaps the junction and the at least part of the solder pad.

2. The electronic device defined in claim 1 wherein the metal bracket has a recess and wherein the protrusion protrudes into the recess.

3. The electronic device defined in claim 2 wherein the housing comprises a peripheral conductive housing structure and wherein the metal bracket is attached to the peripheral conductive housing structure.

4. The electronic device defined in claim 3 further comprising a screw that attaches the metal bracket to the peripheral conductive housing structure.

5. The electronic device defined in claim 4 wherein the peripheral conductive housing structure forms part of an antenna, wherein the screw attaches the metal bracket to the peripheral conductive housing structure at a positive antenna feed terminal, and wherein the metal trace comprises a positive signal line that is coupled to the metal bracket.

6. The electronic device defined in claim 5 wherein the antenna includes an inverted-F antenna resonating element that is at least partly formed from the peripheral conductive housing structure and includes an antenna ground that is separated from the inverted-F antenna resonating element by a gap.

7. The electronic device defined in claim 6 further comprising a return path in the antenna formed from a metal member that spans the gap between the peripheral conductive housing structure and the antenna ground.

8. The electronic device defined in claim 7 wherein the metal member has a meandering path, wherein the electronic device further comprises dielectric on an inner surface of the peripheral conductive housing structure, wherein the meandering path has segments that extend along the peripheral conductive housing structure and that bear against the dielectric to prevent rotation of the metal member, and wherein the metal trace has a pad to which a coaxial cable center conductor is soldered.

9. The electronic device defined in claim 1, wherein the metal bracket has a width and the solder pad extends across the width of the metal bracket.

10. An electronic device, comprising:

a peripheral conductive housing structure;

a dielectric layer on an inner surface of the peripheral conductive housing structure;

a metal member having a meandering path portion that bears against a surface of the dielectric layer, the dielectric layer being interposed between the inner surface and the meandering path portion; and a screw that screws a terminal of the metal member to the peripheral conductive housing structure, wherein the dielectric layer is configured to prevent rotation of the metal member while the screw is rotated to screw the terminal of the metal member to the peripheral conductive housing structure.

11. The electronic device defined in claim 10 further comprising an antenna formed from the peripheral conductive housing structure and an antenna ground that is separated from the peripheral conductive housing structure by a gap.

12. The electronic device defined in claim 11 wherein the metal member is coupled between the peripheral conductive housing structure and the antenna ground and spans the gap.

13. The electronic device defined in claim 12 wherein the metal member has an additional terminal opposite the terminal and wherein the additional terminal is coupled to the antenna ground.

14. The electronic device defined in claim 13 wherein the meandering path portion comprises a plurality of segments that run along the peripheral conductive housing structure and that bear against the dielectric layer.

15. The electronic device defined in claim 14 further comprising:

a flexible printed circuit;

a metal bracket coupled to the peripheral conductive housing structure;

a metal trace on the flexible printed circuit having a metal line segment that is joined to a solder pad for the metal bracket at a junction; and a stiffener having a protruding portion that protrudes into a recess in the bracket and that overlaps the junction.

16. An apparatus, comprising:

a metal housing wall;

a metal member with a meandering path that extends along a first surface of the metal housing wall and that has an end that is screwed to a second surface of the metal housing wall, the second surface being substantially perpendicular to the first surface;

a flexible printed circuit;

a metal bracket that is screwed into the metal housing wall; and a solder pad on the flexible printed circuit that is soldered to the metal bracket.

17. The apparatus defined in claim 16 further comprising:

a metal trace on the flexible printed circuit having a metal line segment that is joined to the solder pad for the metal bracket at a junction; and a stiffener on a surface of the flexible printed circuit and having a protruding portion that protrudes into a recess in the bracket.

18. The apparatus defined in claim 17, wherein the protruding portion of the stiffener overlaps the junction and at least some of the solder pad.

* * * * *